US009626910B2

(12) United States Patent
Xu

(10) Patent No.: US 9,626,910 B2
(45) Date of Patent: Apr. 18, 2017

(54) PIXEL DRIVER CIRCUIT, DISPLAY PANEL AND DRIVING METHOD FOR THE PIXEL DRIVER CIRCUIT

(71) Applicant: SHENZHEN CHINA STAR OPTOELECTRONICS TECHNOLOGY CO., LTD.

(72) Inventor: Xiangyang Xu, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 345 days.

(21) Appl. No.: 14/384,475

(22) PCT Filed: May 13, 2014

(86) PCT No.: PCT/CN2014/077380

§ 371 (c)(1),
(2) Date: Sep. 11, 2014

(87) PCT Pub. No.: WO2015/168954

PCT Pub. Date: Nov. 12, 2015

(65) Prior Publication Data

US 2016/0240138 A1 Aug. 18, 2016

(30) Foreign Application Priority Data

May 9, 2014 (CN) ..... 2014 1 0193937

(51) Int. Cl.
*G09G 3/3258* (2016.01)
*G09G 3/3275* (2016.01)
(Continued)

(52) U.S. Cl.
CPC ..... *G09G 3/3258* (2013.01); *G09G 3/32* (2013.01); *G09G 3/3233* (2013.01);
(Continued)

(58) Field of Classification Search
CPC ..... G09G 3/3258; G09G 3/32; G09G 3/3233; G09G 3/3266; G09G 3/3275
(Continued)

(56) References Cited

U.S. PATENT DOCUMENTS

2015/0084946 A1* 3/2015 Shim ..... G09G 3/3258 345/212
2015/0356924 A1* 12/2015 Chen ..... G09G 3/3233 345/690
(Continued)

FOREIGN PATENT DOCUMENTS

CN 102789761 * 11/2012

*Primary Examiner* — Chanh Nguyen
*Assistant Examiner* — Daniel Duong
(74) *Attorney, Agent, or Firm* — Osha Liang LLP

(57) ABSTRACT

A pixel driver circuit including a first transistor, second transistor, third transistor, fourth transistor, first capacitor, second capacitor, and organic light-emitting diode is provided. A drain of the second transistor is coupled to a cathode of the organic light-emitting diode, and an anode of the organic light-emitting diode is couple to a power line. A source of the second transistor is respectively coupled to drains of the third transistor and the fourth transistor. A source of the third transistor is coupled to a gate of the second transistor, and gates of the third transistor and the fourth transistor receives a compensation control voltage. A source of the fourth transistor is grounded. A shift of the threshold voltage of an AMOLED can be compensated in an embodiment of the present invention, whereby uniformity between a picture and grayscales of the organic light-emitting diodes can be improved.

3 Claims, 7 Drawing Sheets

(51) Int. Cl.

| | |
|---|---|
| ***G09G 3/3266*** | (2016.01) |
| ***G09G 3/32*** | (2016.01) |
| ***G09G 3/3233*** | (2016.01) |
| ***G09G 5/10*** | (2006.01) |

(52) U.S. Cl.
CPC ..... *G09G 3/3266* (2013.01); *G09G 3/3275* (2013.01); *G09G 5/10* (2013.01); *G09G 2300/0814* (2013.01); *G09G 2300/0852* (2013.01); *G09G 2310/027* (2013.01); *G09G 2310/0289* (2013.01); *G09G 2310/08* (2013.01); *G09G 2320/0233* (2013.01); *G09G 2320/045* (2013.01); *G09G 2320/0693* (2013.01); *G09G 2330/028* (2013.01)

(58) Field of Classification Search
USPC ..... 345/77
See application file for complete search history.

(56) References Cited

U.S. PATENT DOCUMENTS

2016/0133187 A1* 5/2016 Li ..... G09G 3/3233
345/690
2016/0240139 A1* 8/2016 Yang ..... G09G 3/3233

* cited by examiner

PIXEL DRIVER CIRCUIT, DISPLAY PANEL AND DRIVING METHOD FOR THE PIXEL DRIVER CIRCUIT

FIELD OF THE INVENTION

The present invention relates to an organic lighting display technology, and especially to a pixel driver circuit, a display panel and a driving method therefor.

BACKGROUND OF THE INVENTION

In an active-matrix organic light-emitting diode (AMOLED) display panel, various effects may result in the deterioration of the uniformity of the panel. Since the brightness of the AMOLED display panel is proportional to the current of the organic light emitting diodes, a level of the current will influence the display uniformity of the AMOLED display panel. If the non-uniformity needs to be controlled within a range of about ±1%, the current of the AMOLED display panel needs to be controlled within the range of ±1%. Since most integrated circuits transmit voltage signals rather than current signals, it is difficult to control the brightness of the pixels to be within the range of ±1% in the AMOLED display panel. Furthermore, the voltage signals have to be transformed into the current signals, and then the results of the transformation are stored in the pixels during a frame period. Actually, since the threshold voltages and mobility of transistors in the AMOLED display panel shift over time, these shortcomings may cause the non-uniformity of the brightness of the display panel.

FIG. 1 is a pixel driver circuit diagram illustrating a prior art AMOLED display panel. A pixel driver circuit 10 of the AMOLED display panel mainly includes a first transistor (TFT1) 102, a second transistor (TFT2) 104, a control capacitor (C) 106, a scan line (Gate n) 108, and a data line (Data n) 110. As shown in FIG. 1, the pixel driver circuit 10 of the typical AMOLED display panel does not include a compensation circuit. When variations of the components in the AMOLED display panel occur, driving voltages and carrier mobility will change together, and the pixel driver circuit 10 of the AMOLED display panel cannot compensate the change of the carrier mobility.

Therefore, as mentioned above, there is a significant need to design a compensation circuit of the pixel driver circuit of the AMOLED display panel such that the uniformity and stability of the brightness of the light emission from the display panel are controlled within a permissible range.

SUMMARY OF THE INVENTION

An objective of the present invention is to design a pixel driver circuit of an AMOLED display panel, whereby the current passing through an organic light-emitting diode is unrelated to the threshold voltage, so as to improve the uniformity and the stability of the brightness of the display panel.

To achieve the foregoing objective, a pixel driver circuit is constructed in the present invention. The pixel driver circuit includes a first transistor, a second transistor, a third transistor, a first capacitor, a second capacitor, and an organic light-emitting diode. The first transistor is a switch of the scan line, and the second transistor is a driving switch of the organic light emitting diode. The first capacitor is utilized to store the grayscale voltages of the data signals transmitted by the data line, whereby the second transistor controls the driving current of the organic light emitting diode. The compensation circuit includes: a third transistor, whose source is coupled to the first capacitor and the second capacitor, and whose drain is coupled to a source of the second transistor; a fourth transistor, whose source is grounded, and whose drain is coupled to the source of the second transistor and a drain of the third transistor. Gates of the third transistor and the fourth transistor are utilized to receive a compensation control voltage.

In one embodiment of the present invention, the third transistor is an n-Channel field effect transistor, and the fourth transistor is a p-Channel field effect transistor.

Another objective of the present invention is to design a compensation method of the pixel driver circuit of an AMOLED display panel such that the uniformity and stability of the brightness of the light emission from the display panel are controlled within a permissible range.

To achieve the foregoing objective, a driving method of the pixel driver circuit is provided in the present invention. The method includes the steps of: turning off the first transistor, turning on the third transistor, and turning off the fourth transistor for compensating the threshold voltage of the second transistor; turning on the first transistor, turning off the third transistor, and turning on the fourth transistor for charging the first capacitor; and turning off the first transistor and the third transistor, turning on the second transistor, the fourth transistor, and the organic light-emitting diode for the organic light-emitting diode to emit light.

In one embodiment of the present invention, the step of turning off the first transistor, turning on the third transistor, and turning off the fourth transistor for compensating the threshold voltage of the second specifically includes: inputting a low voltage level to the scan line such that the compensation control voltage is at a high voltage level, thereby turning off the first transistor, turning on the third transistor, and turning off the fourth transistor for compensating the threshold voltage of the second transistor.

In one embodiment of the present invention, the step of turning on the first transistor, turning off the third transistor, and turning on the fourth transistor for charging the first capacitor specifically includes: inputting a high voltage level to the scan line and inputting a high voltage level to the data line such that the compensation control voltage is at a low voltage level, thereby turning on the first transistor, turning off the third transistor, and turning on the fourth transistor for charging the first capacitor.

In one embodiment of the present invention, the step of turning off the first transistor and the third transistor, turning on the second transistor, the fourth transistor, and the organic light-emitting diode for the organic light-emitting diode to emit light specifically includes: inputting a low voltage level to the scan line and inputting a high voltage level to the power line such that the compensation control voltage is at a low voltage level, thereby turning off the first transistor and the third transistor, turning on the second transistor, the fourth transistor, and the organic light-emitting diode for the organic light-emitting diode to emit light.

To achieve the foregoing objective, the present invention constructs a display panel which includes the above-mentioned pixel driver circuit.

In one embodiment of the present invention, the pixel driver circuit is formed on an array substrate, a plurality of data lines and gate lines are disposed on the array substrate, and the plurality of data lines and gate lines define a plurality of the pixel driver circuits; the array substrate further comprises a driver chip which is utilized to provide a clock signal for the data line, the gate line, and the compensation control voltage and to provide a power signal for the power line.

In one embodiment of the present invention, the display panel is an AMOLED display panel.

In one embodiment of the present invention, a brightness of the display panel is determined by the current passing through the organic light-emitting diode.

The beneficial efficacies of the present invention lie in: by the driving design of the AMOLED display panel, the shift of the threshold voltage of the AMOLED can be compensated, thereby increasing the uniformity between the picture and the grayscales of the organic light-emitting diodes.

It is to be understood that both the foregoing general description and the following detailed description of the present invention are exemplary and explanatory and are intended to provide further explanation of the invention as claimed.

DESCRIPTION OF THE DRAWINGS

FIG. 4A-FIG. 4C are schematic drawings illustrating the pixel driver circuit being turned on.

DETAILED DESCRIPTION OF THE PREFERRED EMBODIMENTS

Figure 1:
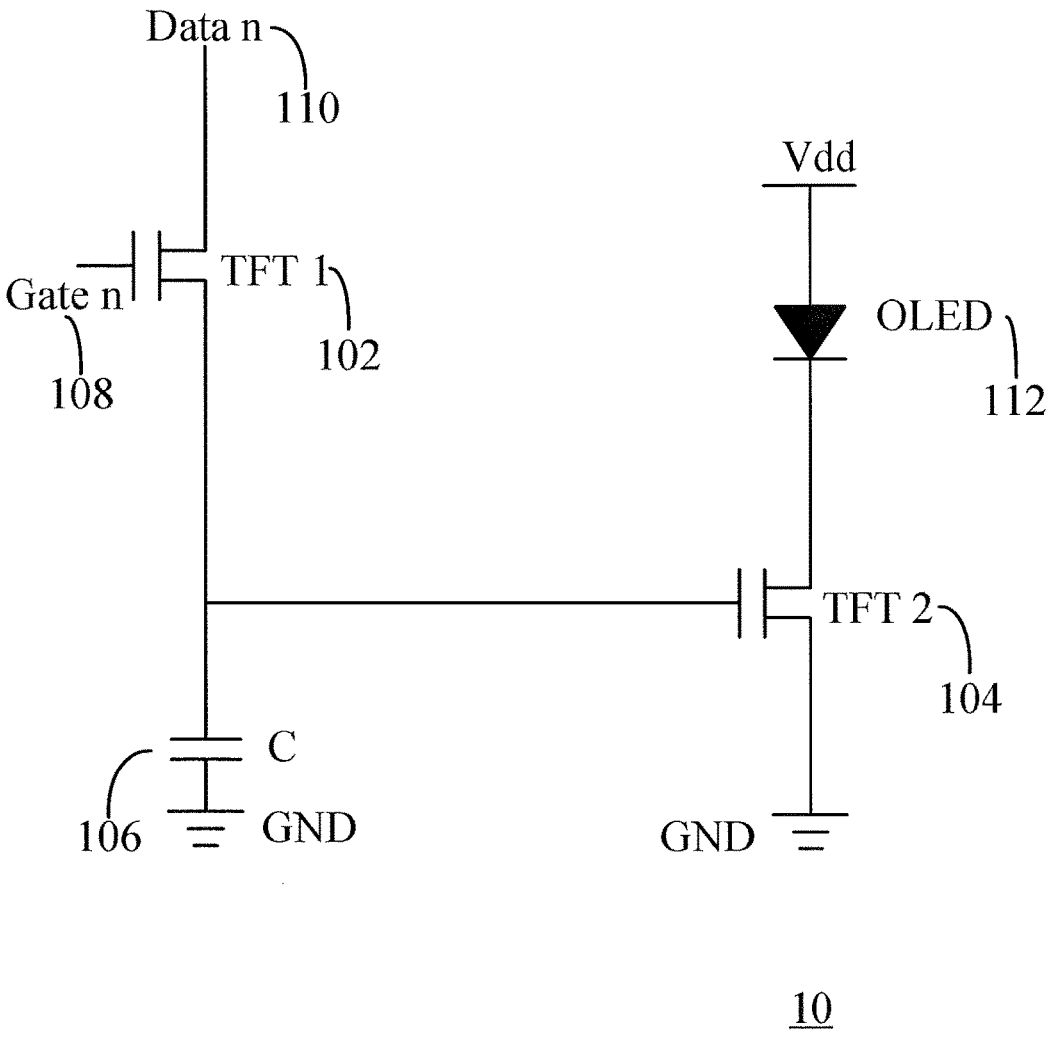
FIG. 1 is a pixel driver circuit diagram illustrating a prior art AMOLED display panel.

The descriptions of the following embodiments refer to the attached drawings which are utilized to exemplify specific embodiments. Directional terms mentioned in the present invention, such as "top" and "down", "front", "rear", "left", "right", "inside", "outside", "side" and so on are only directions with respect to the attached drawings. Therefore, the used directional terms are utilized to explain and understand the present invention but not to limit the present invention. In different drawings, the same reference numerals refer to like parts throughout the drawings.

Figure 2:
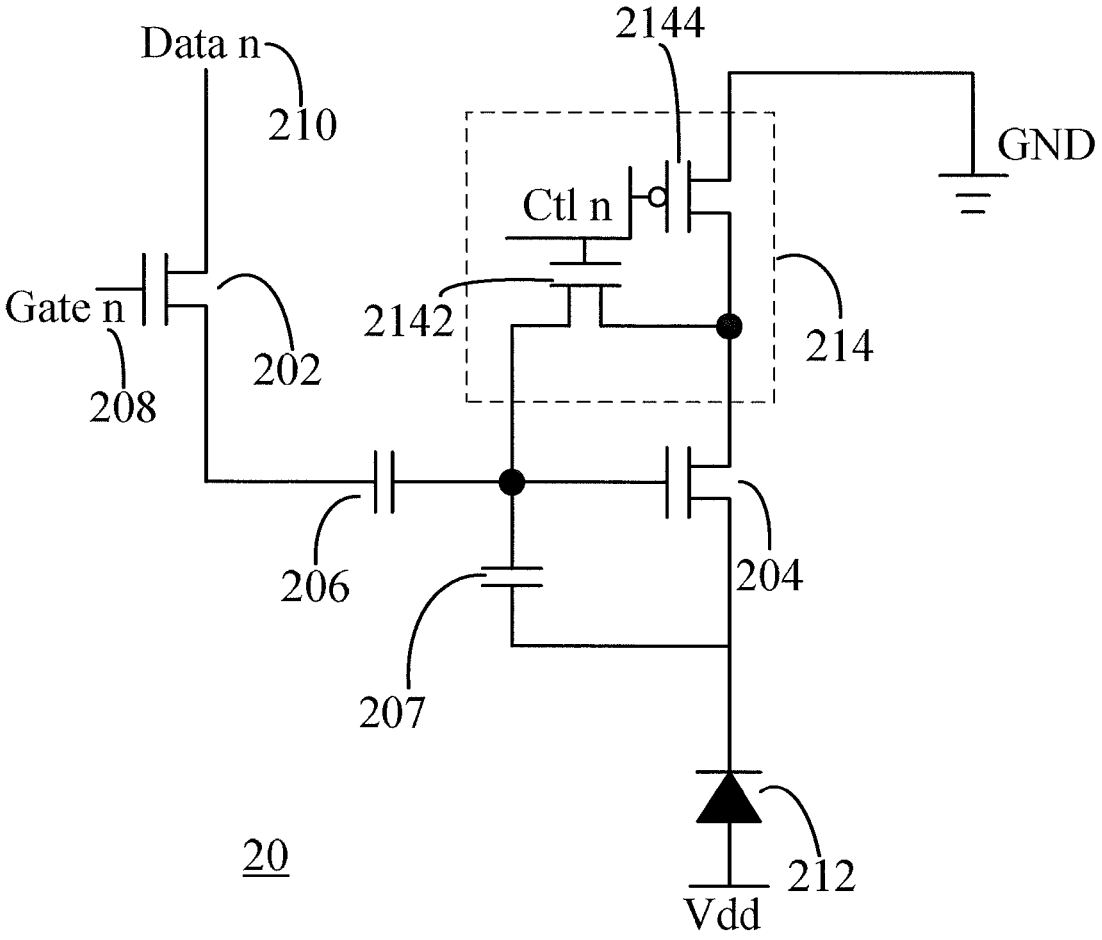
FIG. 2 depicts a pixel driver circuit diagram illustrating an AMOLED display panel according to one preferred embodiment of the present invention.

FIG. 2 depicts a pixel driver circuit diagram illustrating an AMOLED display panel according to one preferred embodiment of the present invention. A pixel driver circuit is formed on an array substrate, and a plurality of data lines and gate lines are disposed on the array substrate. The plurality of data lines and gate lines define a plurality of pixel driver circuits. In addition, the array substrate further includes a driver chip, which is utilized to provide a clock signal for the data line, the gate line, and the compensation control voltage and to provide a power signal for the power line. As shown in FIG. 2, the pixel driver circuit 20 of the AMOLED display panel of the present invention is a 4T2C (four transistors (Thin Film Transistors, TFTs) and two capacitors) circuit, which mainly includes a first transistor (TFT1) 202, a second transistor (TFT2) 204, a first capacitor (C1) 206, a second capacitor (C2) 207, a scan line (Gate Line) 208, a data line (Data Line) 210, an organic light emitting diode (OLED) 212, and a compensation circuit 214. The first transistor 202 is a switch of the scan line 208. The gate of the first transistor 202 is coupled to the scan line 208; the drain thereof is coupled to the data line 210; the source thereof is coupled to one end of the first capacitor 206. The second transistor 204 is a driving switch of the organic light emitting diode 212. The drain of the second transistor 204 is coupled to the cathode of the organic light emitting diode 212, and the gate thereof is coupled to another end of the first capacitor 206. The anode of the organic light emitting diode 212 is coupled to a power line. The first capacitor 206 is utilized to store grayscale voltages of data signals transmitted by the data line 210, whereby the second transistor 204 controls the driving current of the organic light emitting diode 212. The scan line 208 is utilized to transmit scan signals to the transistor so as to control on and off states of the first transistor 202. The data line 210 is used to transmit the data signals to the second transistor 204. The compensation circuit 214 includes a third transistor 2142 and a fourth transistor 2144. The source of the second transistor 204 is respectively coupled to the drains of the third transistor 2142 and the fourth transistor 2144. The source of the third transistor 2142 is coupled to the drain of the second transistor 204. The gate of the third transistor 2142 is coupled to the gate of the fourth transistor 2144 for receiving a compensation control voltage Ctl n. The source of the fourth transistor 2144 is grounded. By means of the compensation control voltage Ctl n controlling the on and off states of the third transistor 2142 and the fourth transistor 2144, the current passing through the organic light-emitting diode 212 is unrelated to the threshold voltage Vth. Accordingly, the brightness problem for the AMOLED display panel is improved, and the uniformity of the display panel is effectively raised. In addition, it should be noted that the first transistor 202, the second transistor 204, and the third transistor 2142 are n-Channel (NMOS) field effect transistors in this embodiment. The fourth transistor is a p-Channel (PMOS) field effect transistor. However, in different embodiments, the NMOS transistors in the embodiment may be changed to the PMOS transistors, and the PMOS transistor may be changed to the NMOS transistor. The invention is not restricted thereto.

Figure 3:
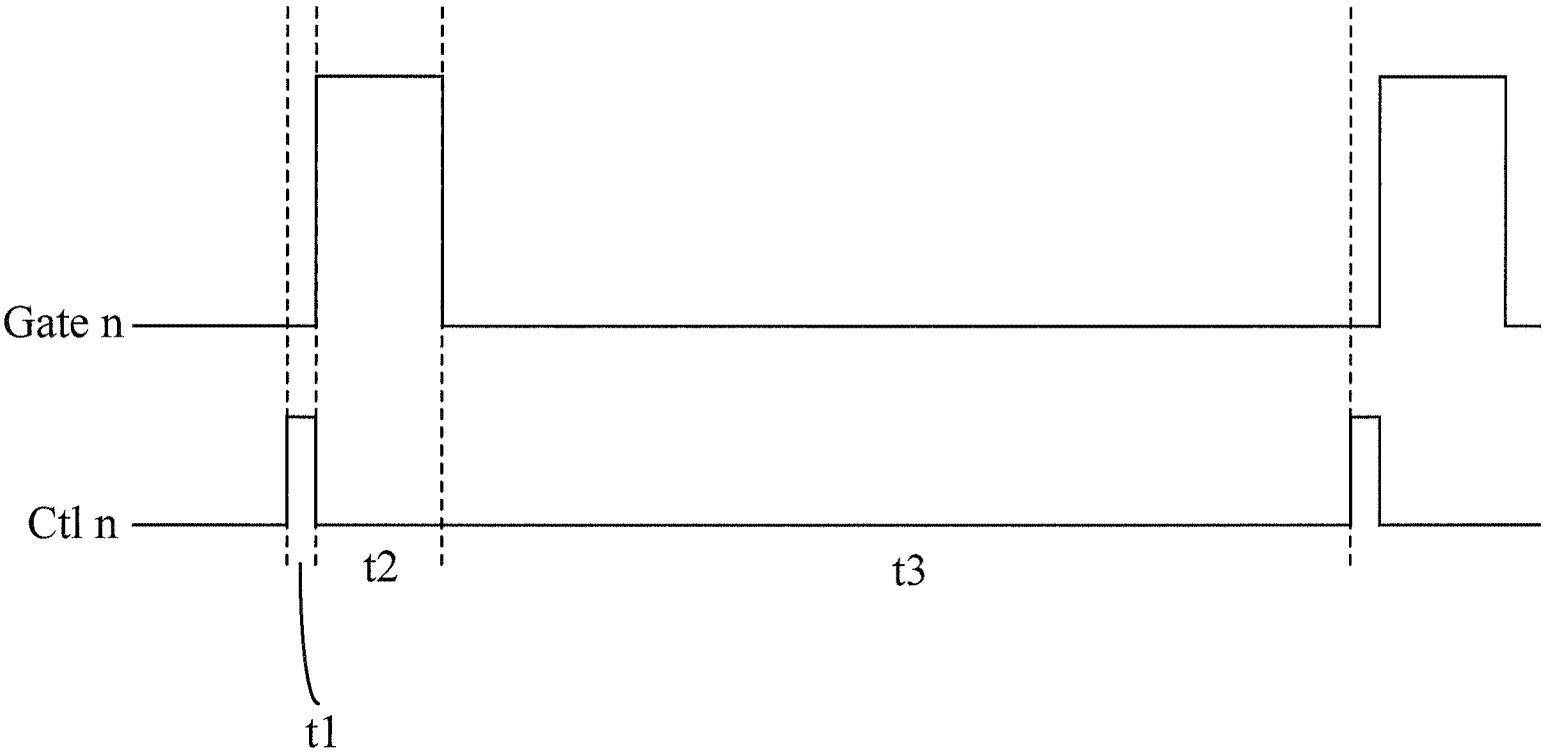
FIG. 3 is a timing chart illustrating the pixel driver circuit of the AMOLED display panel according to the preferred embodiment of the present invention.
Figure 4A:
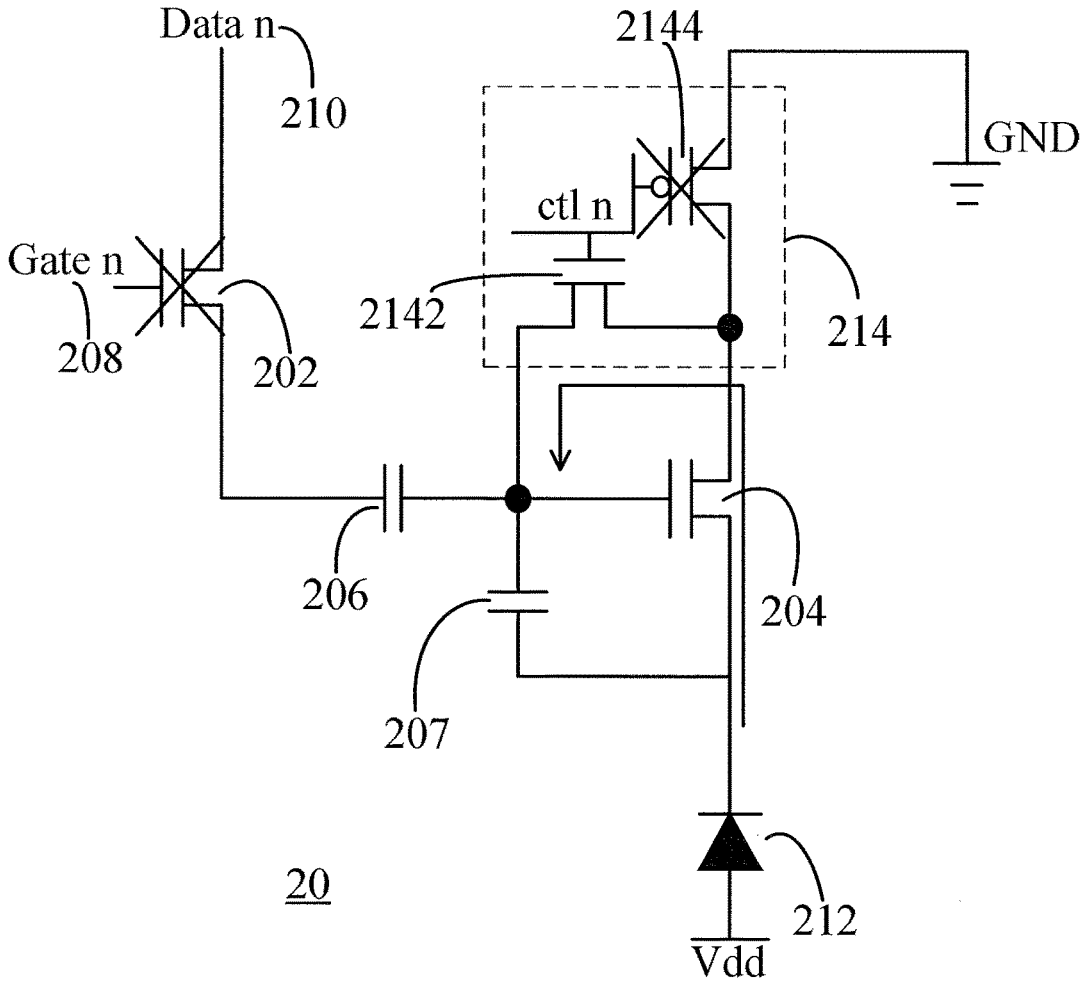
Figure 4B:
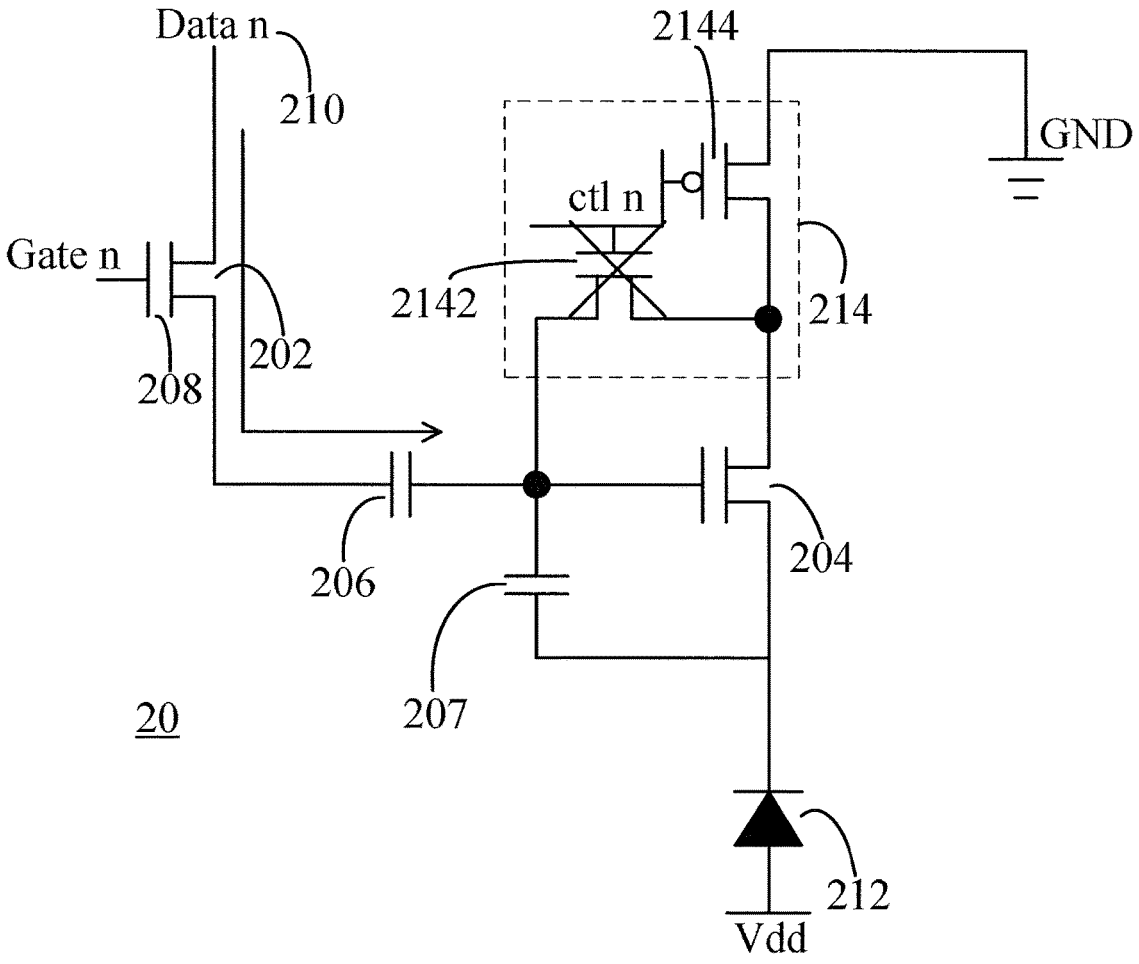
Figure 4C:
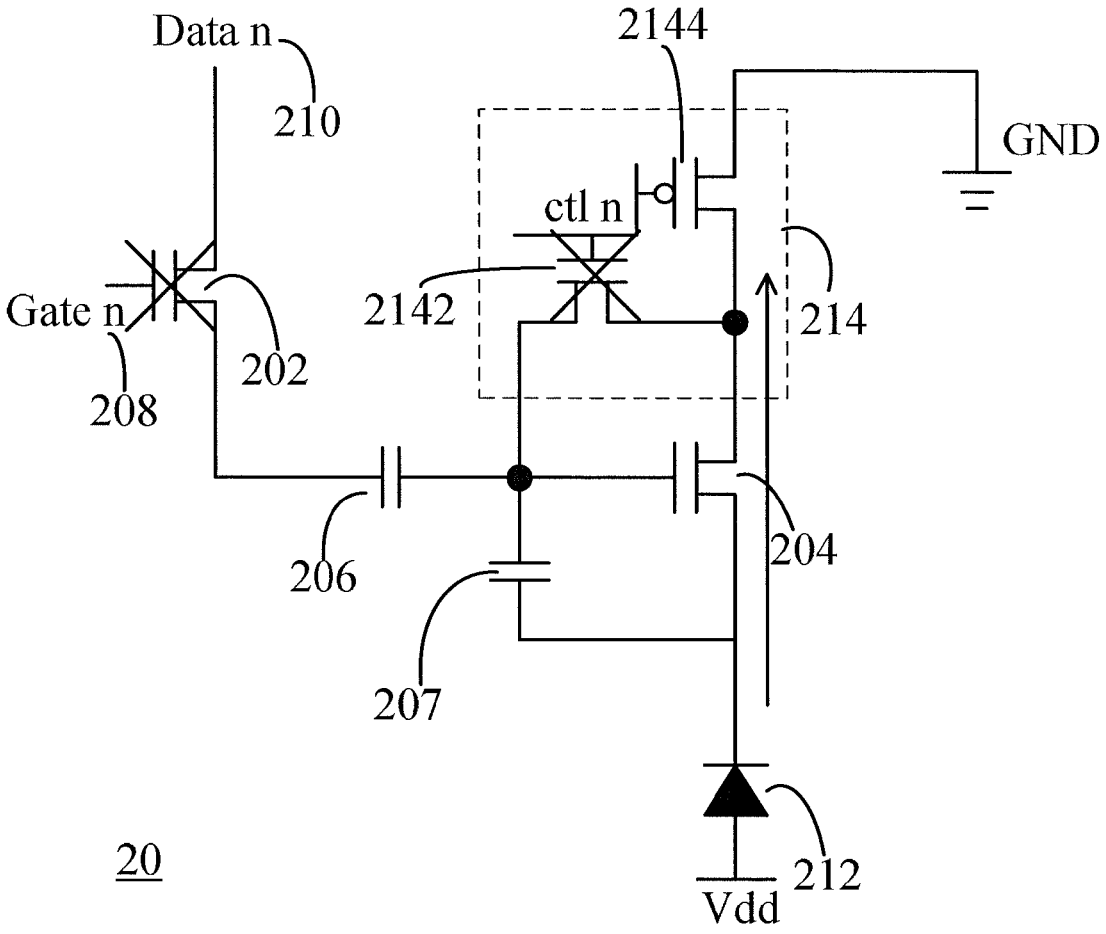

FIG. 3 is a timing chart illustrating the pixel driver circuit of the AMOLED display panel according to the preferred embodiment of the present invention. As shown in FIG. 3, in a first stage t1, this time interval is also called a compensation stage of the threshold voltage Vth. A low voltage level is inputted to the scan line 208, and the compensation control voltage Ctl n is at a high voltage level, so as to turn off the first transistor 204, turn on the third transistor 2142, and turn off the fourth transistor 2144. Under this condition, the gate voltage of the second transistor 204 is the threshold voltage Vth, and is thereby able to compensate the threshold voltage Vth of the second transistor 204 in the first stage t1, as shown in FIG. 4 A. A second stage t2 is a charging period of the first capacitor. A high voltage level is inputted to the scan line 208, and a high voltage level is inputted to the data line 210 for the compensation control voltage Ctl n being at the low voltage level, so as to turn on the first transistor 204, turn off the third transistor 2142, and turn on the fourth transistor 2144. When the first transistor 202 is in the on state, the signal of the data line 210 will be transmitted to the gate of the second transistor 204 and start to charge the first capacitor 206, as shown in FIG. 4B. Meanwhile, the gate voltage of the second transistor 204 is (Vdd−Vdata)*C1/(C1+C2)+Vth, where Vdd is the driving voltage, Vdata is a signal voltage, and the second transistor 204 is in the on state. In accordance with a current formula for the transistor: $I=1/2*Cx*(u*W/L)*(Vg-Vth)^2$, where Cx is an unit-area capacitance of a gate oxide layer of the transistor, u is the electron mobility of the transistor, W is a width of the transistor, and L is a length of the transistor, it can be seen that the current passing through the organic light emitting diode 212 is: $I=1/2*Cx*(u*W/L)*((Vdd-Vdata)*C1/(C1+C2))^2$. Based on the current equation, it can be seen that the current I passing through the organic light-emitting diode 212 is unrelated to the threshold voltage Vth. By means of the design of the third transistor 2142 and the fourth transistor 2144, the current I that passes through the organic light-emitting diode 212 is unrelated to the threshold voltage Vth so that the uniformity of the brightness of the light emission from the display panel is stable and doesn't become unstable with the shift of the threshold voltage. Subsequently, in a third stage t3, a low voltage level is inputted to the scan line 208, and a high voltage level is inputted to the power line 210 for making the compensation control voltage Ctl n at the low voltage level, so as to turn off the first transistor 204, turn off the third transistor 2142, and turn on the fourth transistor 2144. In the stage, the organic light emitting diode 212 in the pixel driver circuit 20 begins to radiate. The uniformity of the display panel is improved by the above-mentioned driving method.

Figure 5:
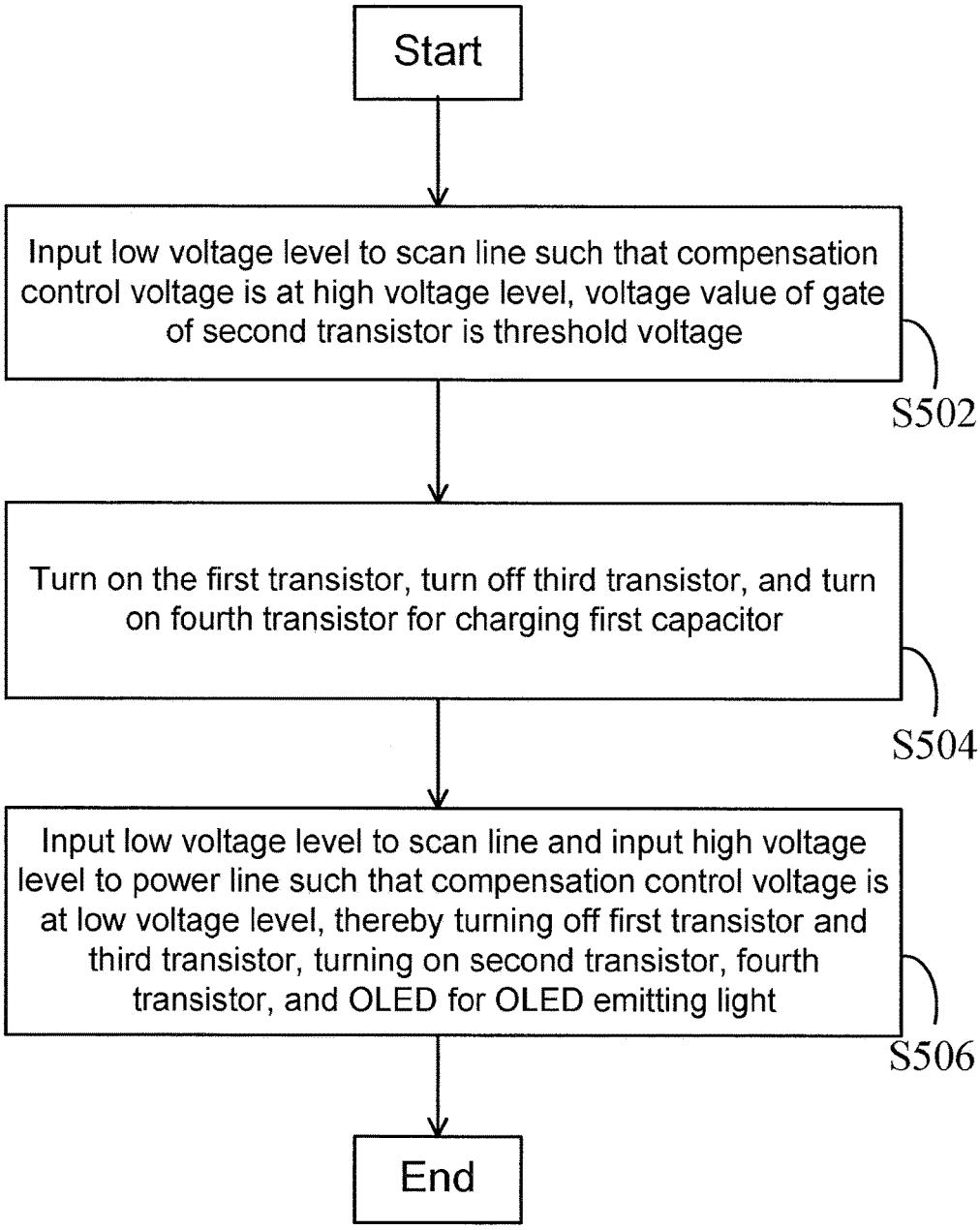
FIG. 5 is a flow chart illustrating a compensation driving method of the pixel driver circuit of the AMOLED display panel of the present invention.

FIG. 5 is a flow chart illustrating a compensation method of the pixel driver circuit of the AMOLED display panel of the present invention. The following description employs the reference numerals in FIG. 3. Similarly, the pixel driver circuit 20 of the AMOLED includes the first transistor (TFT1) 202, the second transistor 204, the first capacitor (C1) 206, the second capacitor (C2) 207, the scan (Gate) line 208, the data line 210, the organic light emitting diode (OLED) 212, and the compensation circuit 214. Then the compensation circuit 214 includes the third transistor 2142 and the fourth transistor 2144. As shown in FIG. 5, in step S502, the first transistor 202 is turned off, the third transistor 2142 is turned on, and the fourth transistor 2144 is turned off for compensating the threshold voltage of the second transistor 204. This stage is also called compensation time of the threshold voltage. In the stage, a low voltage level is inputted to the scan line 208 such that the compensation control voltage is at the high voltage level. The voltage value of the gate of the second transistor 204 is the threshold voltage Vth. In step S504, the first transistor 202 is turned on, the third transistor 2142 is turned off, and the fourth transistor 2144 is turned on for charging the first capacitor 206. A high voltage level is inputted to the scan line 208, and a high voltage level is inputted to the data line 210 for making the compensation control voltage Ctl n at the low voltage level. Thus, the signal of the data line 210 will be transmitted to the gate of the second transistor 204, and the current that passes through the organic light emitting diode 212 is: $I=1/2*Cx*(u*W/L)*((Vdd-Vdata)*C1/(C1+C2))^2$. It is obvious that the equation doesn't have the threshold voltage Vth, and therefore the current I passing through the organic light-emitting diode 212 is unrelated to the threshold voltage Vth. By the above-described driving method of compensation, in the pixel driver circuit 20 of the AMOLED display panel, the current I that passes through the organic light-emitting diode 212 can be unrelated to the threshold voltage Vth. Therefore, the current I that passes through the organic light-emitting diode 212 doesn't cause the non-uniformity of the brightness of the light emission from the AMOLED display panel. Subsequently, in step S506, a low voltage level is inputted to the scan line 208, and a high voltage level is inputted to the power line for making the compensation control voltage Ctl n at the low voltage level, so as to turn off the first transistor 204 and the third transistor 2142, and turn on the second transistor 207, the fourth transistor 2144 and the organic light emitting diode 212. In the stage, the organic light emitting diode 212 begins to radiate. The uniformity of the display panel is improved by the above-mentioned driving method.

As mentioned above, by adding the third transistor and the fourth transistor to the pixel driver circuit of the AMOLED display panel, the threshold voltage Vth of the second transistor is compensated, whereby the current passing through the organic light-emitting diode 212 is unrelated to the threshold voltage Vth. The beneficial efficacies of the present invention lie in: by the driving design of the AMOLED display panel, the shift of the threshold voltage of the AMOLED is compensated, thereby increasing the uniformity between the picture and the grayscales of the organic light-emitting diodes.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and scope of the present invention are within the scope as defined in the appended claims.

What is claimed is:

1. A method for driving a pixel driver circuit, the pixel driver circuit, comprising a first transistor, a second transistor, a third transistor, a fourth transistor, a first capacitor, a second capacitor, and an organic light-emitting diode, a gate of the first transistor coupled to a scan line, a drain of the first transistor coupled to a data line, a source of the first capacitor coupled to one end of the first capacitor, another end of the first capacitor coupled to a gate of the second transistor, a drain of the second transistor directly coupled to a cathode of the organic light-emitting diode, an anode of the organic light-emitting diode coupled to a power line, a source of the second transistor respectively directly coupled to a drain of the third transistor and a drain of the fourth transistor, a source of the third transistor directly coupled to a gate of the second transistor, a gate of the third transistor and a gate of the fourth transistor utilized to receive a compensation control voltage, a source of the fourth transistor being grounded, wherein the compensation control voltage is utilized to control on and off states of the third transistor and the fourth transistor, whereby a current passing through the organic light-emitting diode is unrelated to a threshold voltage of the second transistor, the method comprising:

turning off the first transistor, turning on the third transistor, and turning off the fourth transistor for compensating the threshold voltage of the second transistor;

turning on the first transistor, turning off the third transistor, and turning on the fourth transistor for charging the first capacitor; and turning off the first transistor and the third transistor, turning on the second transistor, the fourth transistor, and the organic light-emitting diode for the organic light-emitting diode to emit light, wherein the step of turning off the first transistor, turning on the third transistor, and turning off the fourth transistor for compensating the threshold voltage of the second specifically comprises:

inputting a low voltage level to the scan line such that the compensation control voltage is at a high voltage level, thereby turning off the first transistor, turning on the third transistor, and turning off the fourth transistor for compensating the threshold voltage of the second transistor.

2. The driving method according to claim 1, wherein the step of turning on the first transistor, turning off the third transistor, and turning on the fourth transistor for charging the first capacitor specifically comprises:

inputting a high voltage level to the scan line and inputting a high voltage level to the data line such that the compensation control voltage is at a low voltage level, thereby turning on the first transistor, turning off the third transistor, and turning on the fourth transistor for charging the first capacitor.

3. The driving method according to claim 2, wherein the step of turning off the first transistor and the third transistor, turning on the second transistor, the fourth transistor, and the organic light-emitting diode for the organic light-emitting diode to emit light specifically comprises:

inputting a low voltage level to the scan line and inputting a high voltage level to the power line such that the compensation control voltage is at a low voltage level, thereby turning off the first transistor and the third transistor, turning on the second transistor, the fourth transistor, and the organic light-emitting diode for the organic light-emitting diode to emit light.

* * * * *